US006851293B2

(12) United States Patent
Begin et al.

(10) Patent No.: US 6,851,293 B2
(45) Date of Patent: Feb. 8, 2005

(54) WIRE REDUCTION DEVICE

(75) Inventors: Rosaire Begin, Trois-Rivières (CA); Alain Champoux, Trois-Rivières (CA)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 10/445,409

(22) Filed: May 27, 2003

(65) Prior Publication Data

US 2004/0237618 A1 Dec. 2, 2004

(51) Int. Cl.[7] ..... B21C 9/00

(52) U.S. Cl. ..... 72/43; 72/281; 140/149; 57/138; 57/311

(58) Field of Search ..... 72/43, 41, 274, 72/278, 281, 64; 140/149; 57/138, 298, 311

(56) References Cited

U.S. PATENT DOCUMENTS

| | | | | | |
|---|---|---|---|---|---|
| 2,109,312 | A | * | 2/1938 | Dimmick | 72/463 |
| 2,252,365 | A | * | 8/1941 | Fisher | 72/463 |
| 2,568,303 | A | * | 9/1951 | Rosenthal | 72/282 |
| 2,724,944 | A | * | 11/1955 | Carleton, et al. | 57/311 |
| 3,128,799 | A | * | 4/1964 | Kerr | 140/149 |
| 3,349,597 | A | * | 10/1967 | Gross, Jr. | 72/286 |
| 3,425,207 | A | * | 2/1969 | Campbell | 57/217 |
| 3,557,588 | A | * | 1/1971 | Catlin | 72/45 |
| 3,946,582 | A | * | 3/1976 | Pietroni | 72/45 |
| 4,292,826 | A | * | 10/1981 | Langenecker | 72/45 |
| 4,445,351 | A | * | 5/1984 | Thompson et al. | 72/43 |
| 4,739,640 | A | * | 4/1988 | Hurst et al. | 72/38 |
| 6,430,980 | B1 | * | 8/2002 | Weinhold et al. | 72/43 |

FOREIGN PATENT DOCUMENTS

| | | | |
|---|---|---|---|
| JP | 60064722 | A | 4/1985 |
| JP | 01011014 | A | 1/1989 |
| JP | 08057531 | A | 3/1996 |
| JP | 2000015324 | A | 1/2000 |
| JP | 2001018007 | A | 1/2001 |

* cited by examiner

*Primary Examiner*—Daniel C. Crane
(74) *Attorney, Agent, or Firm*—Cooper & Dunham LLP

(57) ABSTRACT

A device re-shapes formed wire after processes such as annealing where wire is wound on bobbins. The device includes a reservoir for containing lubricant having a first open end and a second open end. The first end of the reservoir is closed by a guide mechanism for guiding the wire into the reservoir. The second end of the reservoir is closed by a wire shaping for shaping the wire when the wire is pulled therethrough. The wire shaping mechanism reduces the cross-sectional area of the wire by no more than 24%.

3 Claims, 4 Drawing Sheets

WIRE REDUCTION DEVICE

FIELD OF THE INVENTION

The present invention is relates to wire shaping, and more particularly to providing wire its final shape after formation.

BACKGROUND OF THE INVENTION

Production of wire products is generally a multi-step process involving forming the wire from wire rods and the like, annealing the wire and forming the wire into the final product, such as by coating, stranding, etc. Wire rods are drawn to form the wire which is then wound onto bobbins for annealing. After annealing, the wire on the bobbins is unwound and used to form the final product.

After the annealing process the wire is soft; thus, wire unwound from the bobbins after annealing often has significant surface defects resulting from the unwinding. Typically, wire takes a second pass through the drawing machine after being unwound from the bobbin to remove surface defects and re-shape the wire. Since the drawing machine must be capable of significantly reducing the size of a metal rod (e.g. down to the size of wire), the drawing machine is a large, high power, capital intensive piece of equipment. As the unwound wire does not require a large change in size, the use of the drawing machine during the second pass is a less than ideal use of resources.

SUMMARY OF THE INVENTION

In accordance with one aspect of the present invention there is provided a device for re-shaping a formed wire comprising: a reservoir for containing lubricant having a first open end and a second open end in alignment with the first end; a guide mechanism closing the first end of the reservoir for guiding the wire into the reservoir; and a wire shaping mechanism closing the second end of the reservoir for shaping the wire when the wire is pulled therethrough, the wire shaping mechanism reducing the cross-sectional are a of the wire by no more than 24%.

BRIEF DESCRIPTION OF THE DRAWINGS

The present invention will be described in conjunction with the drawings in which.

DETAILED DESCRIPTION

Figure 1:
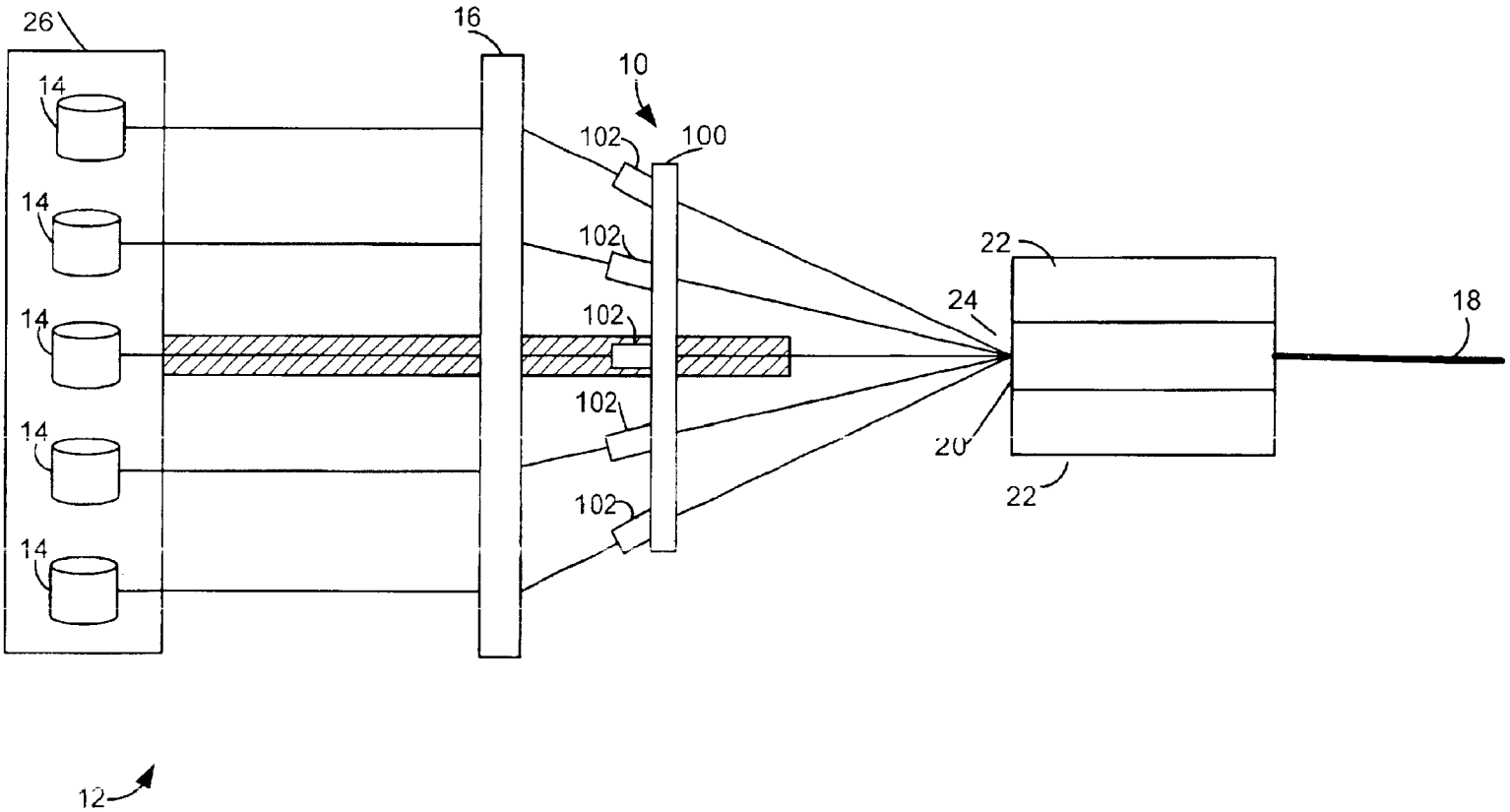
FIG. 1 is block diagram of reduction tube devices according to an embodiment of the present invention in a stranding machine.

Wire formed by drawing is wound on bobbins for annealing and is unwound after annealing for formation of the final product. One such final product is a twisted cable formed by a stranding machine 12, such as the one shown in FIG. 1. Multiple bobbins 14 on which wire is wound are mounted on a bobbin holder 26. These wires are used by the stranding machine 12 to form a twisted cable 18. In a conventional stranding machine 18 wire unwound from each of the bobbins 14 is collected by a rotatable stranding head 16. The bobbin holder 26 and the stranding head 16 are connected by a main arbor 24 that causes both components to rotate. The wires that pass through the stranding head 16 are used to form the twisted cable 18.

After the wires pass through the stranding head 16 they are converged and consolidated by a stranding die 20. The die 20 is mounted in and fixed to a die holder 22. The wire that leaves the die holder 22 has been formed into the twisted cable 18 by the die 20.

FIG. 1 shows a reduction tube devices 10 positioned according to an embodiment of the present invention with the stranding machine 12. The reduction tube device 10 contains multiple reduction tubes 102 positioned along the path of each wire between the stranding head 16 and the die 20. The reduction tubes 102 are connected together by a plate 100. The plate 100 of the reduction tube device 10 is mounted on the main arbor 24 and rotates with the main arbor 24, the stranding head 16 and the bobbin holder 26.

Each reduction tube device 10 processes the wire after it is unwound but before it is stranded to remove surface defects from the wire and provide the final shape. Each reduction tube 102 is oriented such that the wire passing therethrough between the stranding head 16 and the die 20 maintains a relatively straight path. To maintain this straight path, each reduction tube 102 is mounted on the plate 100 at a sufficient angle to provide the straight path.

While FIG. 1 shows the reduction tube device 10 in use with a wire stranding machine 12, the reduction tube device 10 may be used in conjunction with any of a number of apparatuses using wire, including convention assembly, roll forming and processing equipment. In each of these possible environments, the reduction tube device 10 reshapes wire that conventionally would pass through the drawing process a second time.

Figure 2:
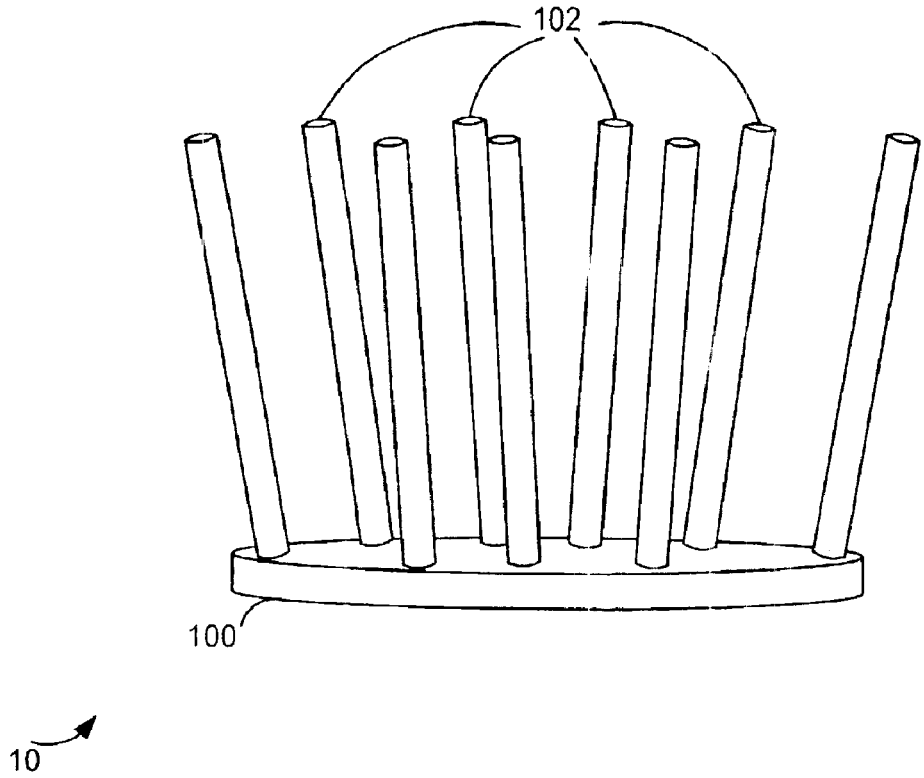
FIG. 2 is an isometric view of the reduction tube device of FIG. 1.

FIG. 2 shows the reduction tube device 10 in detail. The reduction tube device 10 includes multiple reduction tubes 102 attached to a plate 100. Each reduction tube 102 may produce a difference size or shape when wire is passed therethrough. In this manner the reduction tube device 10 can be used for many purposes.

The plate 100 attaches the reduction tube device 10 to a piece of equipment in an intended environment of use (e.g. stranding machine). The plate 100 may be adapted for attachment to the equipment, such as the main arbor 24 of the stranding machine 12, by any suitable fixing means.

Figure 3A:
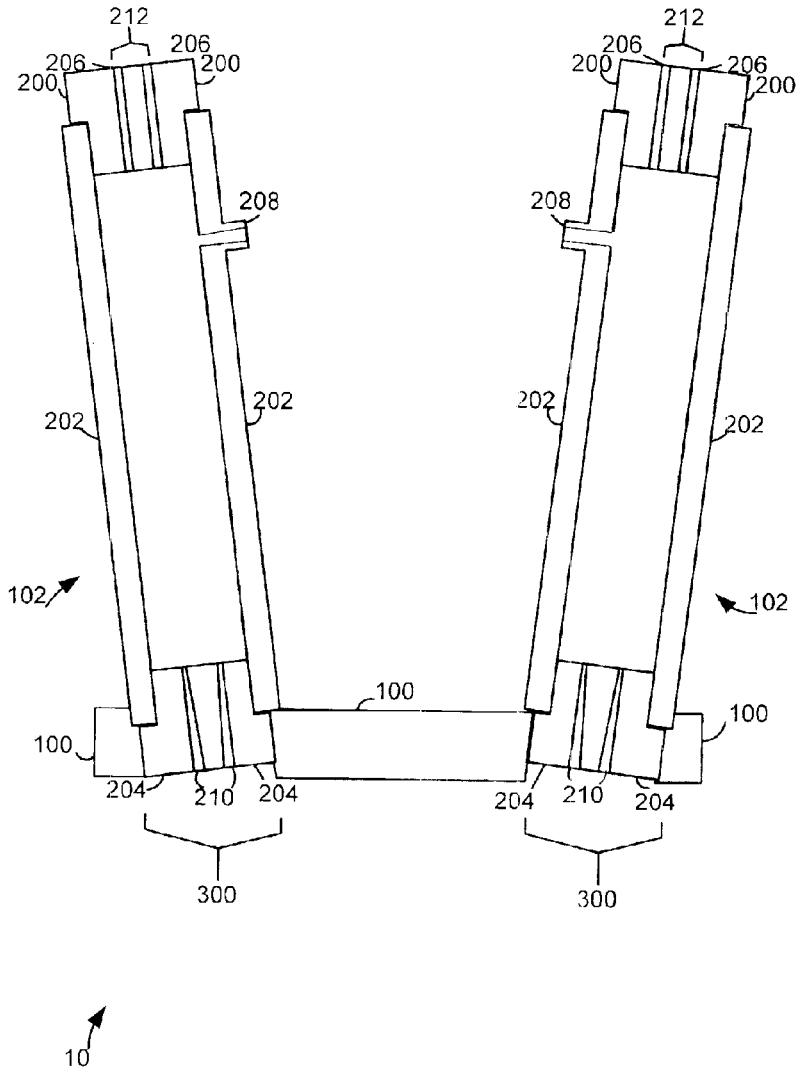
FIG. 3A is a cutaway of the reduction tube device of FIG. 1.
Figure 3B:
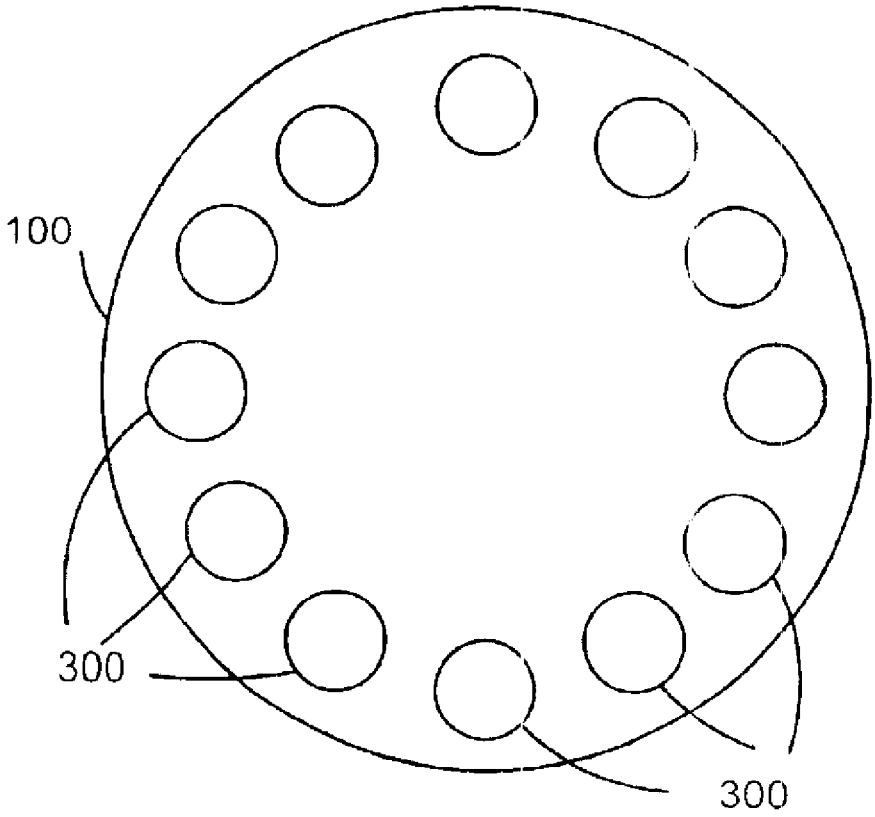
FIG. 3B is a top view of a plate of the reduction tube device of FIG. 1.

As shown by FIG. 3B, the plate 100 has multiple bores 300 circumferentially arranged around the plate 100 for attachment of each of the reduction tubes 102 thereto. Each reduction tube 102 may be attached to the plate 100 at an angle sufficient to maintain a straight wire path through the reduction tube 102 when the plate 100 is mounted in the intended environment. A reduction tube 102 through which the wire is to pass is placed generally coaxially along the path of the wire such that the wire maintains a relatively straight path. Since the disc 100 is attached to an apparatus in the intended environment, the angle at which the reduction tube 102 is attached to the disc 100 is proportionate to the angle between the wire path and the attachment site for the disc 100.

As shown in FIG. 3A, each reduction tube 102 is fixedly attached to the plate 100 with one end of the reduction tube 102 being placed in one of the bores 300 of the plate 100. This allows the wire to pass through the reduction tube 102 and the plate 100.

FIG. 3A is a cutaway view of the reduction tube device 10 showing the plate 100 and a cutaway of two reduction tubes 102. Each reduction tube 102 includes reservoir tube 202 with an incoming cap 200 closing one end and a die holder 204 closing the opposite end. The incoming cap 200 and the die holder 204 are sealingly connected to the reservoir tube 202, for example by a threaded connection.

The incoming cap 200 is positioned on the end of the reduction tube 102 that receives the wire for guiding the wire into the reservoir tube 202. The incoming cap 200 has a bore 212 extending therethrough in which a seal 206 is coaxially placed. In use the wire passes through the bore 212 and the seal 206 and into the reservoir tube 202. The seal 206 fills the space between the wire and the inside of the bore 212 of the incoming cap 200 such that the receiving end of the reduction tube 102 is sealed when the wire passes through the seal 206.

The die holder 204 has a shaping die 210 disposed coaxially therein for shaping the wire as it is pulled therethrough. The shaping die 210 removes surface defects from the wire and provides the final shape of the wire. Since the wire is pulled through the reduction tube 102 by the equipment on which the reduction tube is mounted, reduction of the size of the wire is limited to allow for use of the reduction tube 102 with only minimal additional power form the equipment. The shaping die 210 is shaped to provide a cross-section area reduction for the wire of no more than 24%, preferably only 5%.

The die holder 204 is adapted for insertion into a bore 300 of the plate 100. The die holder 204 is fixed in position in the bore 300, for example by a retaining fixture (not shown) in connection with the plate 100 and the reduction tubes 102.

The reservoir tube 202 acts as a reservoir for holding a lubricating liquid that lubricates the wire as it passes through the reservoir tube 202 to the die holder 204 and the shaping die 210. Since the receiving end of the reservoir tube 202 is sealed by the incoming cap 200 and the seal 206 and the other end is sealed by the de holder 204 and the shaping die 210, the lubricating liquid in the reservoir tube 202 is relatively contained when the wire the pulled therethrough. A refill tube 208 on the reservoir tube 202 allows lubricating liquid to be inserted in to the reservoir tube 202 and added as necessary.

To provide the reduction tube device 10 with multiple reduction tubes 102 producing different shapes and sizes of wire, the shaping die 210 for each reduction tube 102 has a different shape while all other components may be identical for each of the reduction tubes 102. In this manner, the reduction tube device 10 may produce different sizes or shapes of wire.

It will be recognized by one skilled in the art that the dimensions of the device are to be varied according to the desired operation of the invention.

It is apparent to one skilled in the art that numerous modifications and departures from the specific embodiments described herein may be made without departing from the spirit and scope of the invention.

What is claimed is:

1. An apparatus for re-shaping and stranding a plurality of formed wires each having a cross-sectional area, comprising:

a bobbin holder for holding a plurality of bobbins wound with formed wires;

a stranding head for receiving and guiding formed wires unwound from said bobbins;

a stranding die for converging and consolidating said formed wires received from said stranding head:

a reduction tube device between said bobbin holder and said stranding die, said device comprising a plurality of reduction tubes, one for each formed wire, said reduction tubes being interconnected by a plate and each being oriented to maintain a relatively straight path for the formed wire passing therethrough;

said bobbin holder, stranding head and reduction tube device being rotatable relative to said stranding die to cause said formed wires to strand together when passing through said die;

and wherein each said reduction tube has;

a reservoir for containing lubricant having a first open end and a second open end in alignment with said first open end;

a guide mechanism closing said first open end of the reservoir for guiding formed wire into said reservoir; and a wire shaping mechanism closing said second open end of the reservoir for shaping the formed wire when said formed wire is pulled therethrough, the wire shaping mechanism reducing the cross-sectional area of the wire by 24% at most.

2. Apparatus according to claim 1, wherein said reduction tube device is positioned between said stranding head and said stranding die.

3. Apparatus according to claim 1, wherein said wire shaping mechanism reduces said cross-sectional area by 5% at most.

* * * * *